United States Patent [19]

Pedigo

[11] Patent Number: 4,966,204

[45] Date of Patent: Oct. 30, 1990

[54] CARBON FILTER TRAY FILLING MACHINE AND METHOD

[76] Inventor: Roy G. Pedigo, 214 Montclair St., Madison, Ind. 47250

[21] Appl. No.: 301,955

[22] Filed: Jan. 26, 1989

[51] Int. Cl.[5] ..... B65B 1/08

[52] U.S. Cl. ..... 141/7; 141/65; 141/74; 141/286; 366/111; 366/114

[58] Field of Search ..... 141/1, 4, 5, 7, 8, 11, 141/12, 59, 65–67, 69–74, 80, 231–233, 267, 268, 270, 283, 286, 297, 300, 301, 302, 305, 307; 222/196, 200; 366/111, 110, 116, 114, 128, 239, 240

[56] References Cited

U.S. PATENT DOCUMENTS

| | | | |
|---|---|---|---|
| 261,941 | 8/1882 | McCrodden | 141/72 |
| 2,054,253 | 9/1931 | Horsch | 366/114 X |
| 2,718,345 | 9/1955 | Howard | 141/7 |
| 2,780,247 | 2/1957 | Claassen, Jr. | 141/7 |
| 3,182,693 | 5/1965 | Sundberg | 141/268 |
| 3,724,819 | 4/1973 | Varnum et al. | 366/114 |
| 3,858,628 | 1/1975 | Bendle | 141/74 |
| 4,030,639 | 6/1977 | Parish et al. | 141/286 |
| 4,133,281 | 1/1979 | Holmes et al. | 141/1 |
| 4,597,420 | 7/1986 | Schoenthaler et al. | 141/72 |
| 4,648,432 | 3/1987 | Mechalas | 141/12 |

FOREIGN PATENT DOCUMENTS

| | | | |
|---|---|---|---|
| 0142800 | 1/1921 | United Kingdom | 141/73 |
| 328363 | 5/1930 | United Kingdom | 222/200 |

*Primary Examiner*—Henry J. Recla
*Assistant Examiner*—Casey Jacyna
*Attorney, Agent, or Firm*—Woodard, Emhardt, Naughton, Moriarty & McNett

[57] ABSTRACT

A filling machine has a cabinet of generally rectangular configuration and of a suitable size so that a filter tray can be stood on its end inside the cabinet with the fill opening at the top. A filling head on top of the cabinet has a distributor manifold in it for delivering granulated charcoal through an array of pipes into the charcoal bed chambers in the filter tray. An apertured intermediate floor in the cabinet supports the tray. An offal collection box is under that floor. A vacuum is maintained in the cabinet during the filling operation to remove all dust and fines which do not settle in the box. Valves control the vacuum and the rate of flow of the charcoal into the fill chamber. A shaker oscillates the cabinet horizontally during the filling operation to assist in packing.

9 Claims, 3 Drawing Sheets

CARBON FILTER TRAY FILLING MACHINE AND METHOD

BACKGROUND OF THE INVENTION

This invention relates generally to carbon filters having replaceable filter beds, and more particularly to a machine and method for replenishing the carbon material in trays for such filter beds.

A type of filter for removal of radioactive iodine from atmospheric air in nuclear power plants is designated CS-8T by the American Association for Contamination Control (AACC) of Boston, Mass. Such filters include a filter tray having parallel spaced beds of adsorbent carbon which may be, for example, activated cocoanut shell base granular charcoal serving as a carbon dioxide adsorber. These trays must be periodically rejuvenated. It is typically done by removing all of the carbon and replacing it. The conventional procedure known to me for doing so is to mount the tray on a fixture which holds the tray so that the fill end of it faces up. A hopper is fastened to the fill end of the tray. Granular charcoal is dumped from a drum into the hopper and falls from the hopper into the filter tray to fill up the two beds. The fixture has a vibrator attached to it to shake the fixture with the tray therein in a vertical direction to compact the charcoal to the necessary density to meet the specifications for such trays.

This prior art procedure has some attendant problems. These include difficulty in obtaining the desired uniformity of density of charcoal in the filter beds, contamination of the filling charcoal due to environmental dirt or gases, difficulty in control of the charcoal being dumped into the hopper, resulting in contamination of the area around the filter filling station with the charcoal that spills contamination of spilled charcoal making it unusable, and contamination of the air with the charcoal fines that get into the air.

SUMMARY OF THE INVENTION

Described briefly, according to a typical embodiment of the present invention the filling machine comprises a cabinet of generally rectangular configuration and of a suitable size to provide a filling chamber in it where a filter tray can be stood on its end inside the chamber with the fill opening of the tray at the top. A filling head on top of the cabinet has a distributor manifold in it for delivering granulated charcoal through an array of pipes into the charcoal bed chambers in the filter tray. A "false floor" is provided in the cabinet by a horizontal partition at the bottom of and defining the bottom of the filling chamber. This floor has holes therein, and there is a reclamation chamber in the cabinet under the floor. A collection box is provided under that floor to collect any charcoal offal which occurs either during the filling or after striking off the top of the filter tray when the filling has been completed. A vacuum is maintained in the cabinet during the filling operation to remove all dust and fines which do not settle in the reclamation box during the filling operation. Valves are provided to control the level of vacuum and the rate of flow of the charcoal into the fill chamber. A shaker system oscillates the cabinet horizontally during the filling operation to assist in packing.

DESCRIPTION OF THE PREFERRED EMBODIMENT

Figure 1:
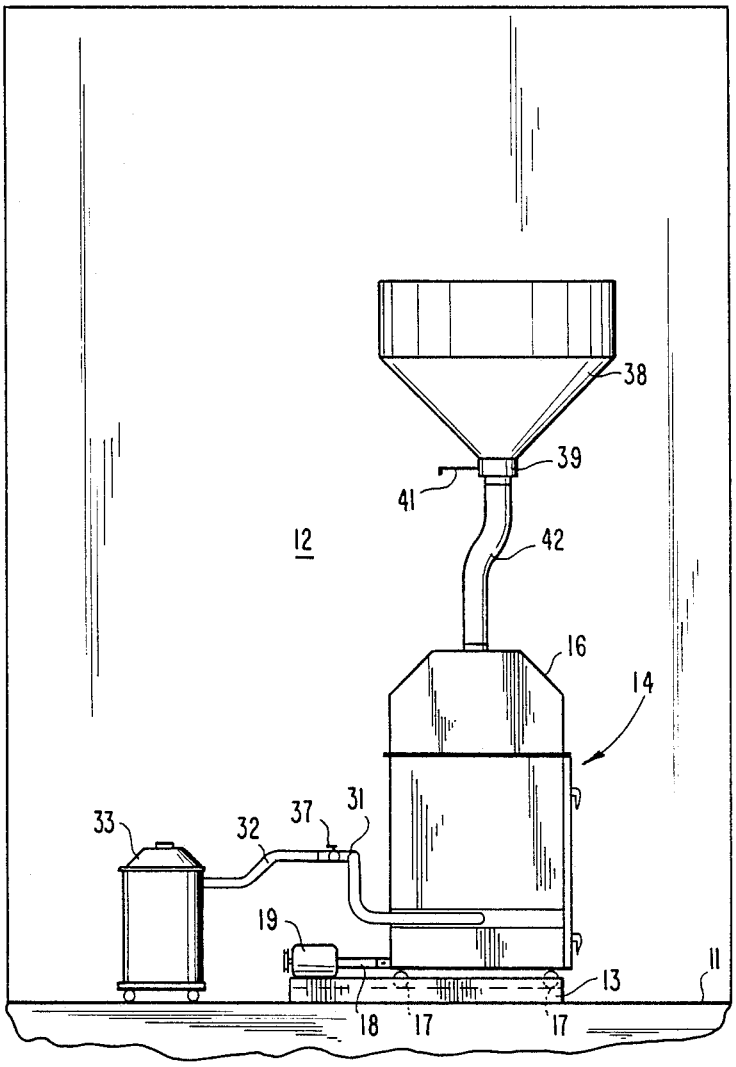
FIG. 1 is an elevational view of the filling system according to a typical embodiment of the present invention.

For the purposes of promoting an understanding of the principles of the invention, reference will now be made to the embodiment illustrated in the drawings and specific language will be used to describe the same. It will nevertheless be understood that no limitation of the scope of the invention is thereby intended, such alterations and further modifications in the illustrated device, and such further applications of the principles of the invention as illustrated therein being contemplated as would normally occur to one skilled in the art to which the invention relates.

Referring now to the drawings in detail, and more particularly to FIG. 1, the machine is shown on the floor 11 of a filter room 12 shown schematically. The machine itself includes a base 13, cabinet 14 and fill head 16. The cabinet is mounted to the base on rollers 17. It is oscillated horizontally by a connecting rod 18 driven by a motor 19. The manner in which this is done can be seen better by referring to FIG. 3 wherein it is seen that the motor has a pulley on its output shaft, driving a belt 21, which drives the input pulley of a speed reducer 22, having a disk 23 on its output shaft and which has a crank pin 24 therein. A connecting rod or link 26 is pinned to the crank Pin 24 and in a yoke 27 at the base of the cabinet.

A vacuum system is used and includes headers 28 on opposite sides of the cabinet with a manifold 29 connected to each header and joined to the outlet pipe 31. This is coupled by a flexible hose 32 to the intake of a conventional vacuum cleaning machine 33 of the workshop vacuum ("Shop Vac") type 33. Since this type of vacuum cleaner is typically without provision for controlling vacuum, a side draft pipe 34 (FIG. 3) is connected into the outlet pipe 31 and has a draft control valve 36 in it operable by the handle 37 to permit entry of air from atmosphere and thus control the draft and thereby the vacuum in the manifold 29 and headers 28.

Further referring to FIG. 1, a filler material storage hopper 38 is supported in the room 12 by a suitable wall or ceiling structure. It has a throttle valve assembly 39 at the bottom of it operable by handle 41, this being typically a gate valve. The flexible discharge hose 42 is connected from the valve assembly 39 to the top of the fill head 16.

Figure 3:
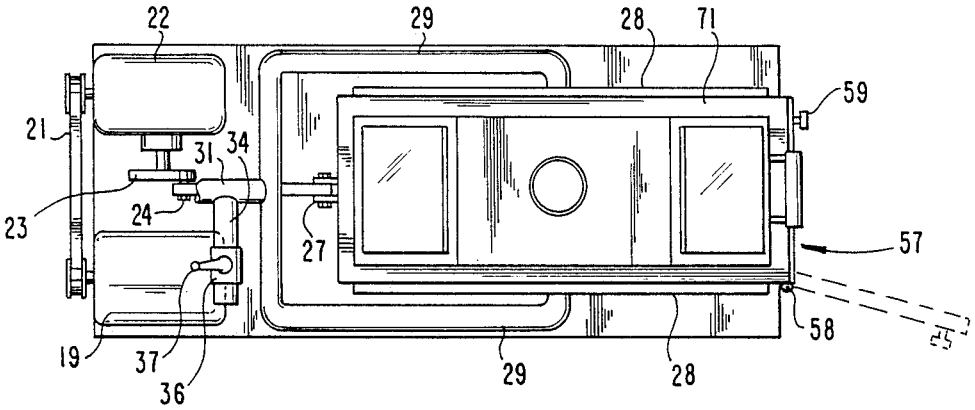
FIG. 3 is a top plan view thereof.
Figure 4:
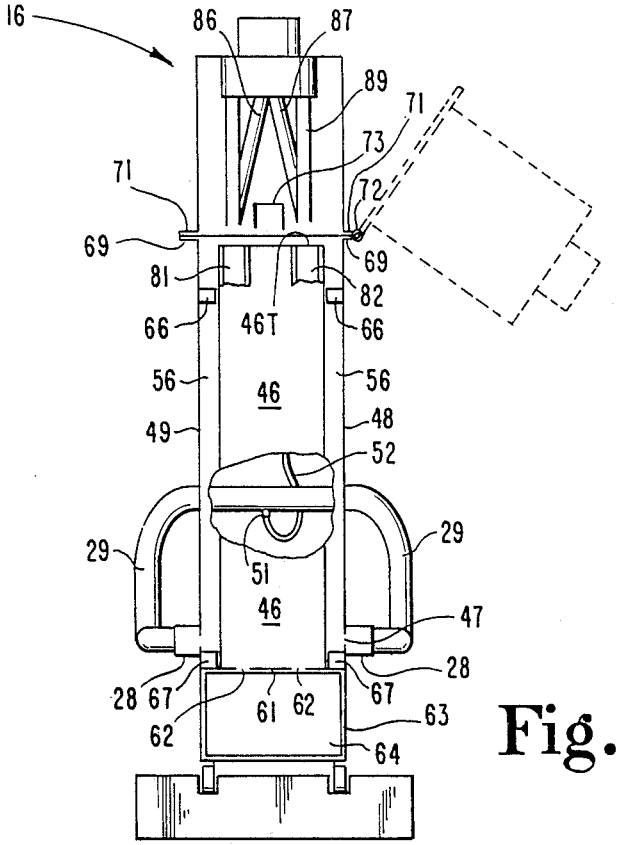
FIG. 4 is a transverse sectional view therethrough at line 4—4 in FIG. 2 and viewed in the direction of the arrows.

Referring to FIGS. 3 and 4, the cabinet is shown with a filter cell or tray 46 inside in position to be filled. A bottom portion of the filter tray is broken away in FIG. 2 to show the four outlet holes 47 in the wall 48 of the cabinet and which communicate with the header 28 on that wall. The same arrangement is provided at wall 49 of the cabinet. A portion of the filter tray 46 and back wall 54 of the cabinet is broken away in FIG. 4 to show through the cabinet to the manifold 29 as it crosses at the rear of the machine. There is a ¼ inch fitting 51 on the bottom of this manifold at this location and to which is connected a tube 52 connected to a U-2 manometer 53 mounted on the outside rear wall 54 of the cabinet to enable reading the vacuum applied to the cabinet fill chamber 56, in which the filter tray is located during filling.

The filter cell or tray is inserted through a front door 57 hinged to the cabinet wall at 58 and securable in the closed position by locking handles 59. It can be opened to the position shown in the doted line in FIG. 3 to enable insertion and removal of the filter traY 46.

An intermediate floor 61 is provided in the cabinet defining the lower margin of the fill chamber 56. It includes two rows of apertures 62 communicating from the fill chamber to the reclamation chamber 63 in which the offal collection box 64 is located. As an example, there are two rows of the openings 62 and six such openings in each of the rows.

The cabinet includes upper and lower side guides 66 and 67, respectively, to hold the sides or faces of the filter tray away from the walls of the cabinet. An upper guide extension 68 is shown at the rear wall 54 in FIG. 2. This prevents the filter tray from being pushed in entirely against the rear wall 54. Consequently, there is approximately a one inch spacing between the filter tray and each of the walls 48 and 49, and about a two inch spacing between the tray and the front door 57 and the rear wall 54.

Figure 5:
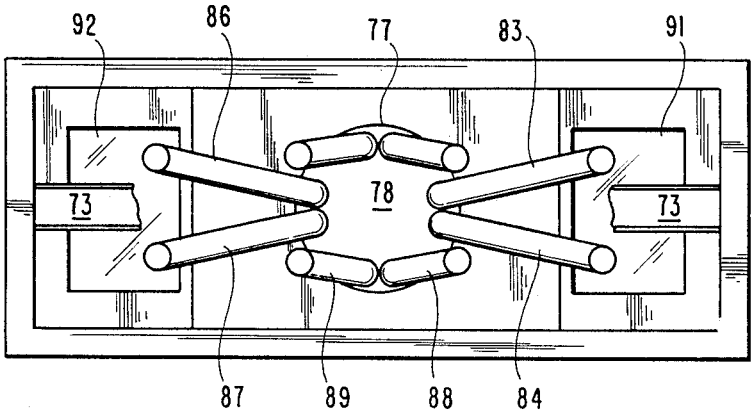
FIG. 5 is a still further enlarged bottom view of the fill head portion of the machine.

The cabinet has a perimetrical flange 69 around the top of the fill chamber. Similarly, the head 16 has a perimetrical flange 71 around its lower edge. They are hinged together at 72 (FIG. 4). There is an inverted channel member 73 secured in the head and which serves as a centerline shield. Its location can best be seen in FIGS. 4 and 5. It covers the center slot in the filter tray and which is provided for the air entry between the two filter beds in the CS-8T filter trays when they are in use in an air filtering system. The shield is located very close to the open top 46T of the filter tray 46. That top is also immediately below the parting line of the two flanges 69 and 71.

Figure 2:
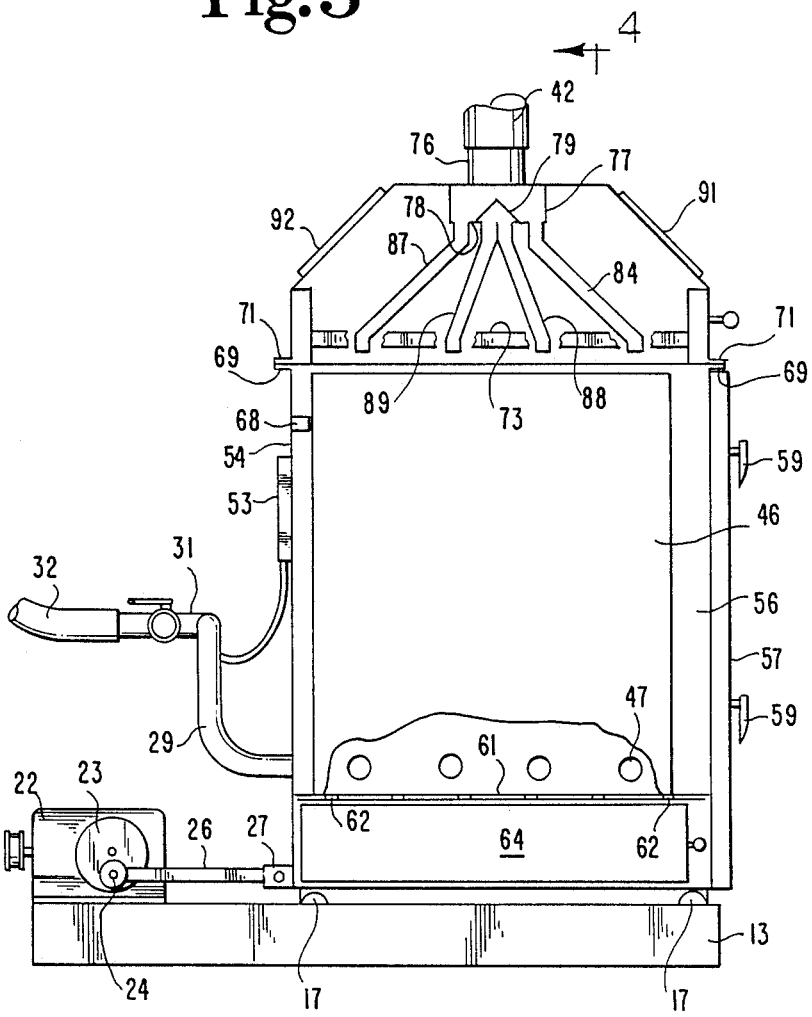
FIG. 2 is an enlarged vertical sectional view through the center of the filling machine itself.

Referring further to FIGS. 2 and 4, the fill head includes the centrally located four inch pipe fitting 76 at the top. This enters a distributor box 77 which has eight holes in the bottom of it arranged in four groups of two, the groups being equally spaced in a circle around the box bottom 78 adjacent the cylindrical wall of the box. A distribution cone 79 is centrally located in the box bottom and distributes the entering filler material evenly among the eight entry holes in the bottom of the box.

Each of the eight outlet holes is connected to a distribution Pipe or nozzle. These pipes have outlets in two rows spaced over the individual filter cell beds in the filter tray, these being designated fragmentarily and schematically at 81 and 82 in FIG. 4. The two distribution pipes 83 and 84 at the front deposit carbon into the beds 81 and 82, respectively, as do the pipes 86 and 87 at the rear. Similarly, the pipes 88 and 89 deposit carbon in the bed 82. Their counterparts on the opposite side of the box deposit carbon in the bed 81. The lower ends of these pipes are spaced slightly above the top of the filter tray as is apparent in FIGS. 2 and 4, but it is slightly below the center line shield 73 as is also apparent in those two views.

In order to assist in observation of the filling operation. front and rear observation windows 91 and 92 are provided in the sloped front and rear top walls of the fill head.

OPERATION

In the use of the system, if the filter tray is one which has a removable face plate to open the end for filling the face plate (not shown) is removed. Then the cabinet door 57 of the present invention is opened and the filter is inserted between the guide rails and pushed along floor 61 to the rear until stopped by the rear rail 68. The collection box 64 is empty and in place. Then the access door 57 is closed and latched. The fill head, which may originally be open as shown by the dotted lines in FIG. 4 if desired to assist in loading the filter tray or for other reasons is then moved to position shown by the solid outline in Fig. 4. Then the vacuum machine is turned on and the valve 36 adjusted by operation of the handle 37 until the desired vacuum of approximately 28 inches of water is established. The mating flanges are adequately sealed by a closed cell neoprene seal on the lower face of the flange 71 sealing against the upper face of the flange 69 on the cabinet. The front door is sealed to the cabinet in the same way. The gate valve 41 is closed and, being covered by granular charcoal in the hopper 38, provides an ample seal at that location. Thus, by the turning on the vacuum cleaner machine 33, it is easy to pull the desired vacuum. The level or amount of vacuum, which can be read by looking at the manometer 53, can be modified as desired by operation of the valve 37 to admit as much air from the atmosphere as is desired to obtain the desired vacuum. Then the shaker motor 19 is started and the valve 41 is opened to the extent desired to provide the proper rate of fill of box 77 and discharge therefrom through the eight pipes into the two beds in the filter tray. As the granular charcoal enters from the hopper 33, so does a certain amount of air (although not much) so that a modest flow is provided through the fill chamber and out the outlets 47 near the floor thereof and into the vacuum cleaner. The normal filtering system in the vacuum cleaner collects the charcoal fines and dust in the air, and the filtered exhaust is discharged to atmosphere in the normal way that shop vacuum machines operate. This discharge can be piped outdoors if desired.

The rate of flow of charcoal and the extent of filling of the trays can be observed through the windows 91 and 92. When they are filled to the top, the valve 41 is closed, the shaker stopped, and the vacuum turned off. Then the head, with the hose 42 remaining attached, is tipped over to the position shown by the dotted outline in Fig. 4. Any loose charcoal on the top of the tray or any ledges therein can be struck off with a brush and falls to the floor 61. Then the door 57 is opened and the filter tray removed, whereupon the face plate is installed and the filter tray can then be wrapped, as desired to protect from atmospheric contamination, and stored for later use or shipment to a user destination.

After a number of trays have been filled, the offal which has collected on the floor 61 and fallen through the openings into the collection box 64 can be removed by pulling out the collection box 64. Because the environment within the cabinet has remained relatively clean from all but filling room air entrained contaminants, the charcoal in the collection box can be poured into the hopper 38 if desired for subsequent filling operations. Handles can be provided on the front of the collection box 64 and on the front of the head 16 as shown for convenient tilting of the head on its hinge 72 and for convenient removal of the box 64.

The fill material is preferably an activated cocoanut shell base granular charcoal of 8×16 mesh size. The hopper may be of any configuration that will provide the desired gravity movement of the charcoal to the outlet 41. It can be a round hopper of forty-eight inch diameter converging to a four inch diameter outlet at the valve 39, for example, or it can be a forty-eight inch square hopper converging to the valve 39. These are just examples. The cabinet is typically made of steel. The rollers 17 may be of any type suitable to handle the oscillations imparted by the connecting rod 26. It is conceivable that they might preferably be located in tracks which confine the rollers both at the top and bottom so that they would resist any tilting movement about an axis parallel to the fill head hinge 72.

While the invention has been illustrated and described in detail in the drawings and foregoing description, the same is to be considered as illustrative and not restrictive in character, it being understood that only the preferred embodiment has been shown and described and that all changes and modifications that come within the spirit of the invention are desired to be protected.

The invention claimed is:

1. A carbon filter filling machine comprising:

a base;

a cabinet mounted on said base and having a fill chamber therein to receive a filter cell for filling the cell with carbon, the cabinet having a top;

a filling head on the top of the cabinet for delivering carbon to the top of a filter cell in the cabinet;

and exhaust outlet means in the cabinet below the filling head to enable establishment of an air flow through the cabinet from the filling head through the fill chamber to the exhaust outlet means;

a shaker on the base and connected to the cabinet to oscillate the cabinet and thereby promote packing of the carbon in the filter cell;

the filling head further comprising:

a downwardly opening shell having a top and bottom and front and rear ends and an inlet port at the top;

a distributor box having a top and bottom and connected to the top of the shell and located under the port to receive carbon granules entering through the port;

a plurality of outlets in the bottom of said box; and discharge passages from said outlets to spaced points near the bottom of the shell.

2. The machine of claim 1 and further comprising:

a centrally located shield under said box and extending from end to end of said shell bottom to cover a slot in a filter cell to be filled in said fill chamber.

3. The machine of claim 1 wherein:

said cabinet and said shell have outwardly extending and matching perimetrical flanges at the bottom of said shell and at the top of said cabinet, respectively, and one of said flanges is hinged to the other whereby said head is pivotable outwardly to uncover the top of said cabinet, one of said flnges having seal means thereon sealable with the other of said flanges when said head covers said cabinet to close the top of said cabinet and provide a leak inhibiting seal between said head and said cabinet at said flange.

4. The machine of claim 1 wherein:

said distributor box has a circular wall and is centered below said inlet port;

said outlets are spaced in a circle near said wall;

said shell bottom is elongate rectangular; and said passages are pipes extending from said outlets to said spaced points and which are situated in two parallel rows.

5. The machine of claim 1 and wherein:

said outlets are arranged in four pairs circularly spaced about the axis of said port, and there are eight of said pipes, two of said pipes from a front pair of outlets having lower ends opening at two points in different rows near the front end of said shell, two of said pipes from an intermediate pair of outlets having lower ends opening at spaced points in one row, two of said pipes from an intermediate pair of outlets having lower ends opening at spaced points in the other row, and two of said pipes from a rear pair of outlets having lower ends opening at points in different rows but near the rear end of the shell.

6. A carbon filter filling machine comprising:

a base;

a cabinet mounted on said base and having a fill chamber therein to receive a filter cell for filling the cell with carbon, the cabinet having a top;

a filling head on the top of the cabinet for delivering carbon to the top of a filter cell in the cabinet;

and exhaust outlet means in the cabinet below the filling head to enable establishment of an air flow through the cabinet from the filling head through the fill chamber to the exhaust outlet means;

a shaker on the base and connected to he cabinet to oscillate the cabinet and thereby promote packing of the carbon in the filter cell;

said shaker being arranged to oscillate said cabinet horizontally;

said cabinet including a pair of horizontally-spaced roller means to roll on said base; and said shaker including a motor mounted to said base, and a speed reducer mounted to said base and coupled to and driven by said motor and having an output shaft and a crank pin connected to said output shaft, and a link connected to said crank pin and to said cabinet whereby rotation of said output shaft causes said crank pin and link to roll said cabinet horizontally in oscillation on said base.

7. A carbon filter filling machine comprising:

a base;

a cabinet mounted on said base and having a fill chamber therein to receive a filter cell for filling the cell with carbon, the cabinet having top;

a filling head on the top of the cabinet for delivering carbon to the top of a filter cell in the cabinet;

and exhaust outlet means in the cabinet below the filling head to enable establishment of an air flow through the cabinet from the filling head through the fill chamber to the exhaust outlet means;

a shaker on the base and connected to the cabinet to oscillate the cabinet and thereby promote packing of the carbon in the filter cell;

said shaker is arranged to oscillate said cabinet horizontally;

said cabinet having an intermediate floor at the bottom of said fill chamber defining a reclaim chamber before said foil chamber and having an array of apertures in the intermediate floor;

a collection box in said reclaim chamber;

said access door covering said reclaim chamber for access to and removal of said box of accumulated carbon in said reclaim chamber; and said exhaust outlet means being located in spaced walls of said cabinet above said floor.

8. A carbon filter filling machine comprising:

a base;

a cabinet mounted on said base and having a fill chamber therein to receive a filter cell for filling the cell with carbon, the cabinet having a top;

a filling head on the top of the cabinet for delivering carbon to the top of a filter cell in the cabinet;

an exhaust outlet means in the cabinet below the filling head to enable establishment of an air flow through the cabinet from the filling head through the fill chamber to the exhaust outlet means;

a shaker on the base and connected to the cabinet to oscillate the cabinet and thereby promote packing of the carbon in the filter cell;

a partition means extending horizontally in said cabinet and defining a reclaim chamber below said fill chamber;

a collection box in said reclaim chamber;

said access door covering said reclaim chamber for access to and removal of said box of accumulated carbon in said reclaim chamber; and an access door covering said front end only for access to said fill chamber to permit insertion of a filter cell for filling and to permit removal of the filter cell after filling and to permit access to said reclaim chamber.

9. A method of filling with adsorbent granules, a filter cell having a top with a fill opening, the method comprising the steps of:

placing the filter cell in a cabinet having a top, with the fill opening up;

establishing a vacuum in the cabinet with air outlets primarily near the bottom of the filter cell;

dropping granules into the top of the filter cell at a plurality of spaced locations which are discrete and fixed relative to the cabinet and cell while maintaining a flow of air from the top of the cabinet toward the lower exterior of the cabinet;

shaking the filter cell horizontally while dropping the granules into the cell; and collecting offal granules in a box below the filter in the cabinet under vacuum during the granule dropping step.

* * * * *